United States Patent [19]

Yonemoto

[11] Patent Number: 4,928,021

[45] Date of Patent: May 22, 1990

[54] ELEVATOR CONTROL APPARATUS

[75] Inventor: Masashi Yonemoto, Inazawa, Japan

[73] Assignee: Mitsubishi Denki Kabushiki Kaisha, Japan

[21] Appl. No.: 301,716

[22] Filed: Jan. 26, 1989

[30] Foreign Application Priority Data

Jan. 28, 1988 [JP] Japan ..... 63-18069

[51] Int. Cl.[5] ..... B66B 5/02

[52] U.S. Cl. ..... 187/108; 187/140

[58] Field of Search ..... 187/105, 108, 140

[56] References Cited

U.S. PATENT DOCUMENTS 4,465,162 8/1984 Yokota ..... 187/105
4,719,995 1/1988 Ikejima ..... 187/119
4,833,380 5/1989 Magee ..... 187/108 X

FOREIGN PATENT DOCUMENTS 60-42151 9/1985 Japan .

*Primary Examiner*—A. D. Pellinen
*Assistant Examiner*—W. E. Duncanson, Jr.
*Attorney, Agent, or Firm*—Leydig, Voit & Mayer

[57] ABSTRACT

An elevator control apparatus comprises a torque control device for calculating a torque command for a motor for hoisting an elevator cage, a brake which operates in response to a braking command so as to restrain the motor, a brake abnormality detector adapted to operate when a difference between a maximum value and a minimum value of the torque command is less than a predetermined value, and a brake abnormality output circuit which delivers a predetermined signal when an inferior release of the brake has been detected by the operation of the brake abnormality detector.

3 Claims, 8 Drawing Sheets

(a) CAGE SP (b) TORQUE COM IN RATED LOAD MODE (c) TORQUE COM IN BALANCED LOAD MODE (d) TORQUE COM IN NO-LOAD MODE (a) CAGE SP (b) TORQUE COM IN RATED LOAD MODE (c) TORQUE COM IN BALANCED LOAD MODE (d) TORQUE COM IN NO-LOAD MODE

ELEVATOR CONTROL APPARATUS

BACKGROUND OF THE INVENTION

This invention relates to an elevator control apparatus, and more particularly to the detection of any abnormality in the brake gear of an elevator system.

FIG. 9 shows an example of a known brake gear disclosed in the official gazette of Japanese Patent Application Publication No. 60-42151. Referring to the figure, the brake gear comprises brake arms 1, a frame 2, spring guide rods 3 which are secured to the frame 2 and on which the respective brake arms 1 are loosely fitted, compression springs 4 which are respectively fitted round the spring guide rods 3 and which afford forces urging the upper ends of the corresponding brake arms 1 in the directions of coming near to each other, bolts 5 which are threadably mounted on the respective brake arms 1, and actuating arms 6 in the shape of letter Z, both of which are pivotally mounted on the frame 2 by pins 7 and one end of each of which has its position regulated by the fore end of the corresponding bolt 5. A plunger rod 8 stands upright in abutment against the other ends of the actuating arms 6, a plunger 9 is connected to the plunger rod 8, and a housing 10 is formed of a cylindrical magnetic material provided in its bottom with a hole for loosely fitting the plunger rod 8 and is supported by the frame 2. A brake coil 11 is arranged outside the housing 10, and a braking operation-detecting switch 12 is mounted on the frame 2 and is actuated by the plunger 9.

In operation, when the brake coil 11 is energized, the plunger 9 moves down, and the plunger rod 8 depresses the actuating arms 6. Thus, the actuating arms 6 turn about the corresponding pins 7 so as to open the brake arms 1 through the corresponding bolts 5 against the forces of the compression springs 4. As a result, an electric motor not shown is released from the restraint of the brake arms 1.

Meanwhile, the movement of the plunger 9 is monitored by the operation detecting switch 12. When the operation of the plunger 9 has become abnormal due to any cause, the operation detecting switch 12 detects this situation and finds the abnormality of the brake gear.

The brake gear in the prior-art elevator control apparatus has been constructed and operated as stated above. Therefore, the mounted position of the detecting switch 12 needs to be adjusted for precisely detecting the movement of the plunger 9.

Moreover, wiring needs to be laid from the detecting switch 12 to a control panel. This is problematic in points of saving labor and conserving resources.

SUMMARY OF THE INVENTION

This invention has been made in order to solve the problems mentioned above, and has for its object to provide an elevator control apparatus in which the abnormality, especially the inferior release of a brake gear can be detected even when the operation of a plunger is not detected as in the prior art.

An elevator control apparatus according to this invention comprises torque control means for calculating a torque command for a motor for hoisting an elevator cage, a brake which operates in response to a braking command so as to restrain the motor, brake abnormality detection means adapted to operate when a difference between a maximum value and a minimum value of the torque command is less than a predetermined value, and a brake abnormality output circuit which delivers a predetermined signal when an inferior release of the brake has been detected by the operation of the brake abnormality detection means.

The elevator control apparatus of this invention operates as follows: When the release of the brake is inferior, the difference (torque difference) between the maximum value and minimum value of the torque command value during one travel becomes smaller than in a normal operation. Therefore, this situation is detected by the brake abnormality detection means, and the predetermined signal is delivered by the brake abnormality output circuit.

BRIEF DESCRIPTION OF THE DRAWINGS

Throughout the drawings, the same symbols indicate identical or equivalent portions.

DESCRIPTION OF THE PREFERRED EMBODIMENTS

Now, an embodiment of this invention will be described with reference to FIG. 1.

Figure 1:
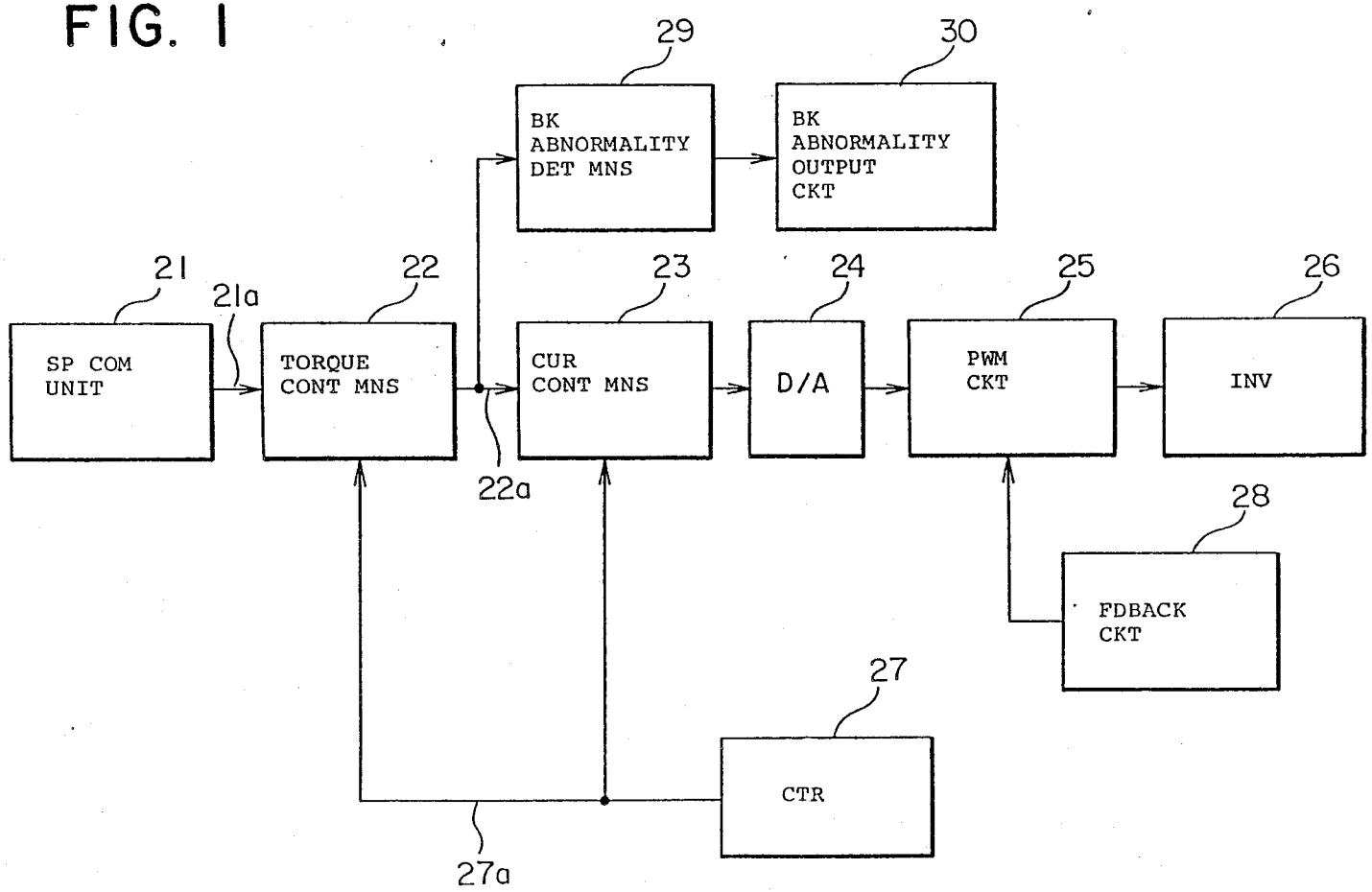
FIG. 1 is a block diagram of an elevator control apparatus according to an embodiment of this invention.

FIG. 1 is a block diagram showing one embodiment of this invention. Referring to the figure, the elevator control apparatus of the embodiment comprises a speed command unit 21 which generates the speed command 21*a* of an elevator cage, torque control means 22 for calculating the torque command 22*a* of an electric motor in response to the speed command 21*a* and a speed feedback signal 27*a* to be described later, current command means 23 for calculating the value of current to be caused to flow through the motor, in response to the torque command 22*a* and the speed feedback signal 27*a*, a digital-to-analog converter (hereinbelow, termed "D/A converter") 24 which converts the digital output value of the current command means 23 into an analog value, a well-known PWM (pulse width modulation) circuit 25 which modulates and controls the pulse width of a square wave pulse on the basis of the current command, and an inverter 26 which changes a direct current into an alternating current of variable voltage and variable frequency under the control of the PWM circuit 25. The apparatus further comprises a counter 27 which counts pulses generated by a pulse generator 37 to be described later (refer to FIG. 2) and produces the speed feedback signal 27*a*, a current feedback circuit 28 which feeds a motor current back to the PWM circuit 25, brake abnormality detection means 29 to be described in detail later, and a brake abnormality output circuit 30 which notifies a brake abnormality to the exterior of the apparatus.

Figure 2:
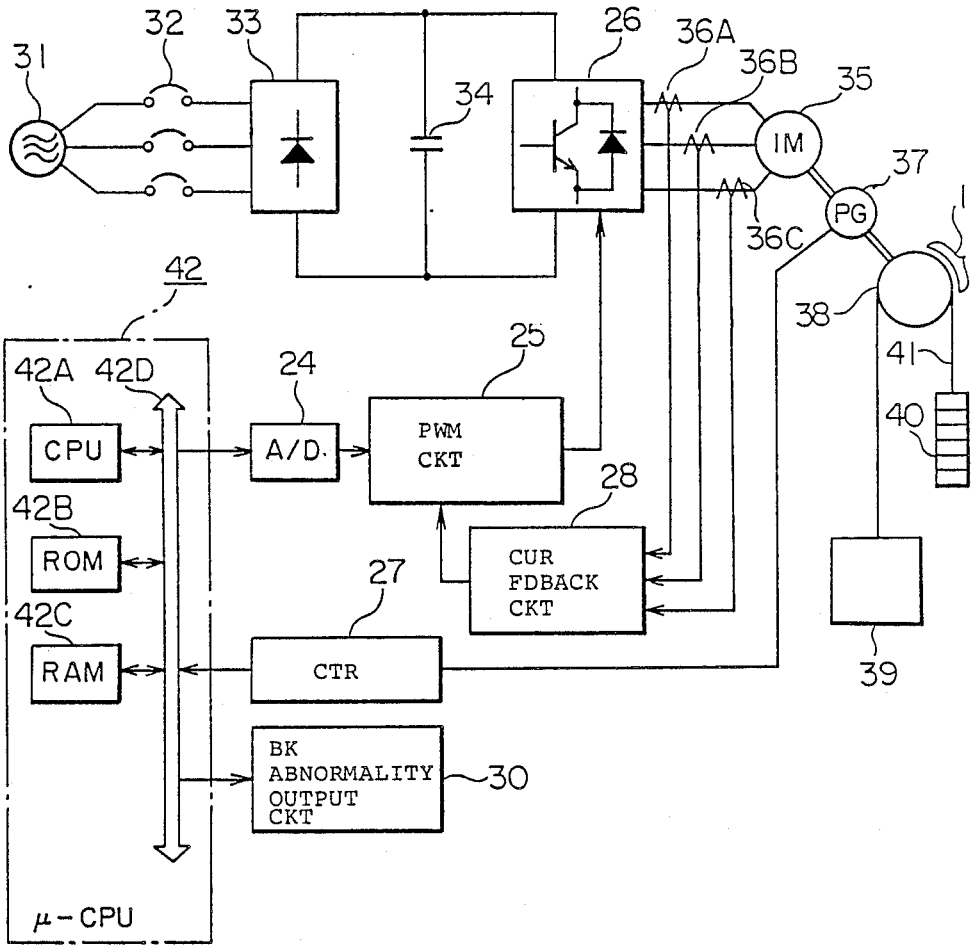
FIG. 2 is a diagram of the whole circuit arrangement of a control apparatus to which this invention is applied.

FIG. 2 is a diagram of the whole circuit arrangement of an elevator control apparatus to which this invention is applied. Referring to the figure, the elevator control apparatus includes a three-phase A.C. power source 31, a circuit breaker 32, a converter 33 which converts the alternating current of the three-phase A.C. power source 31 into a direct current, a capacitor 34 which smooths the converted direct current, an induction motor 35 which serves to hoist the elevator cage, current transformers 36A–36C which detect the respective phase currents of the induction motor 35, the pulse generator 37 which detects the r. p. m. (revolutions per minute) of the induction motor 35, a sheave 38, the elevator cage 39, a counterweight 40, and a rope 41. Further, the apparatus includes a microcomputer 42 which executes programs for the torque control means 22, the current command means 23 and the brake abnormality detection means 29. The microcomputer 42 is constructed of a central processing unit (CPU) 42A, a read only memory (ROM) 42B, a random access memory (RAM) 42C, and a bus 42D for addresses, data etc.

Next, the operations of the circuits shown in FIGS. 1 and 2 will be described. The alternating current of the three-phase A.C. power source 31 is rectified and converted into the direct current by the converter 33. This direct current is smoothed by the capacitor 34, and is supplied to the inverter 26.

Figure 9:
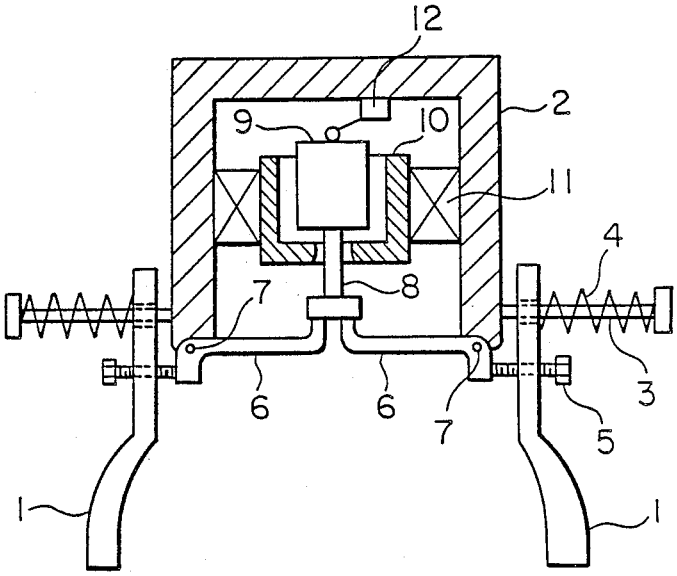
FIG. 9 PRIOR ART
FIG. 9 is a schematic sectional view of a brake gear in a prior-art example.

When a cage start command, not shown, has been given, the brake coil 11 shown in FIG. 9 is energized to open the brake arms 1. Thus, the restraint of the induction motor 35 is released. At the same time, the speed command unit 21 operates to supply the torque control means 22 with the speed command 21*a*. The torque control means 22 calculates the torque command 22*a* on the basis of the speed command 21*a* and the speed feedback signal 27*a*, and feeds it to the current command means 23. The current command means 23 calculates the value of the current to flow through the motor 35, on the basis of the torque command 22*a* and the speed feedback signal 27*a*.

Subsequently, the current value calculated as a digital quantity is converted into an analog quantity by the D/A converter 24. The PWM circuit 25 modulates the width of the square wave pulse on the basis of the analog current value, and operates the inverter 26. In this way, the direct current delivered from the converter 33 is inverted into the alternating current of variable voltage and variable frequency by the inverter 26 so as to supply the induction motor 35 with the alternating current. Thus, the induction motor 35 rotates, and the cage 39 starts running.

Meanwhile, the respective phase currents flowing to the induction motor 35 are detected by the current transformers 36A–36C and are subjected to waveform processing by the current feedback circuit 28, whereupon the processed current is fed back to the PWM circuit 25. Thus, the current of the induction motor 35 is controlled so as to precisely follow the command value of the current command means 23.

Besides, the r. p. m. of the induction motor 35 are detected by the pulse generator 37, and the number of pulses from the pulse generator 37 is counted by the counter 27 and is fed back to the torque control means 22 and the current command means 23 as the speed feedback signal 27*a*. Under these controls, the cage 39 is controlled at high accuracy.

Figure 3:
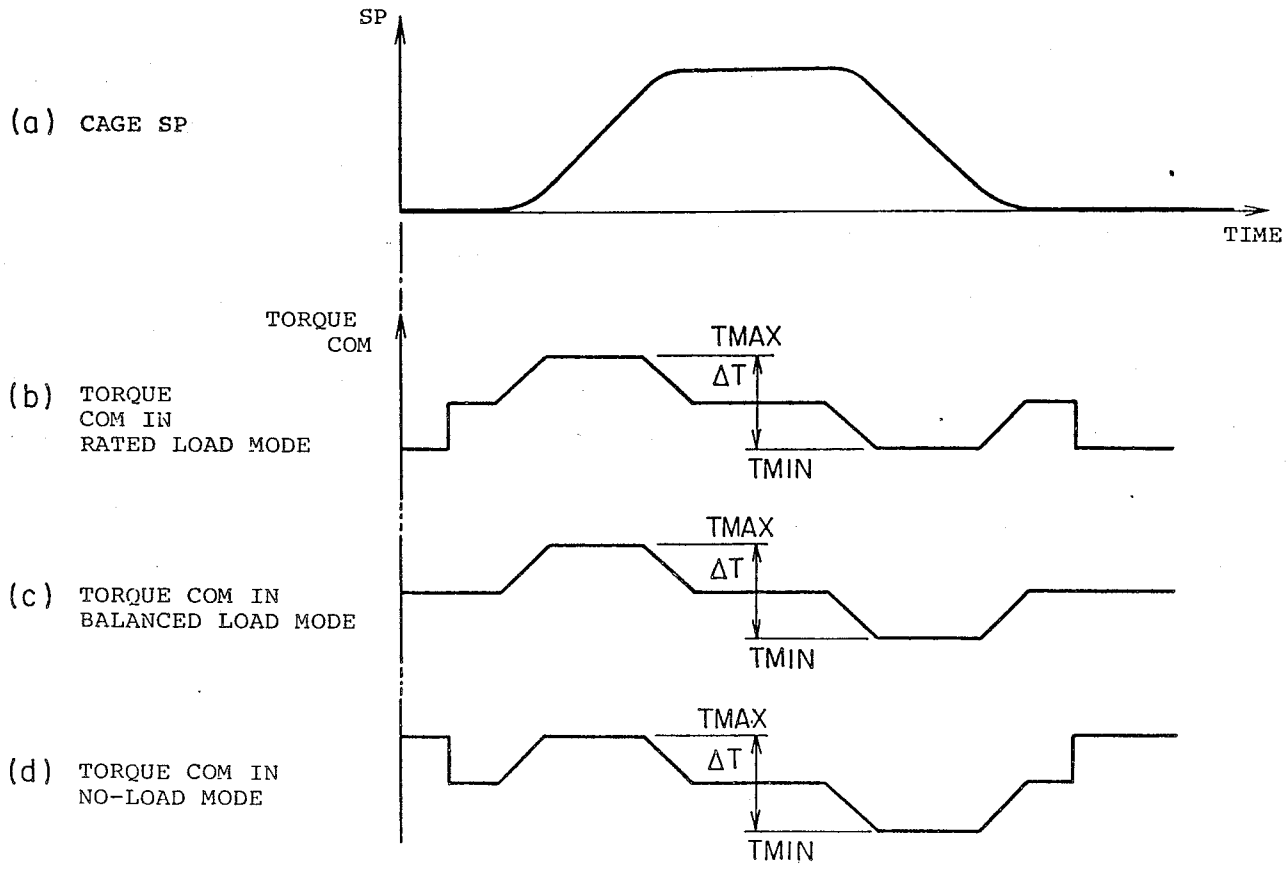
FIG. 3 is a characteristic diagram showing the relationships between a cage speed and a torque command in the ascending operation of an elevator cage.

Next, the torque command 22*a* during an elevator operation will be described in detail. FIG. 3 shows the relationships between the cage speed and the torque command in the ascending operation of the elevator cage. (a) in FIG. 3 illustrates the cage speed in the ascending operation, (b) the torque command 22*a* in the case where the cage burdened with a rated load performs the ascending operation, (c) the torque command 22*a* in the case where the cage burdened with a balanced load performs the ascending operation, and (d) the torque command 22*a* in the case where the cage in a no-load state performs the ascending operation. The torque command 22*a* is the sum between an unbalance torque which is ascribable to the difference of the weights of the cage 39 and the counterweight 40, and an acceleration torque which is required for accelerating an inertial system. During the ascending operation, the torque command 22*a* becomes the maximum value TMAX in an acceleration condition and the minimum value TMIN in a deceleration condition. Strictly speaking, in the no-load mode, the moment of inertia becomes smaller than in the rated load mode, with the result that the acceleration torque decreases. Roughly speaking, however, a torque difference $\Delta T = TMAX - TMIN$ in one travel may be considered substantially constant.

Figure 4:
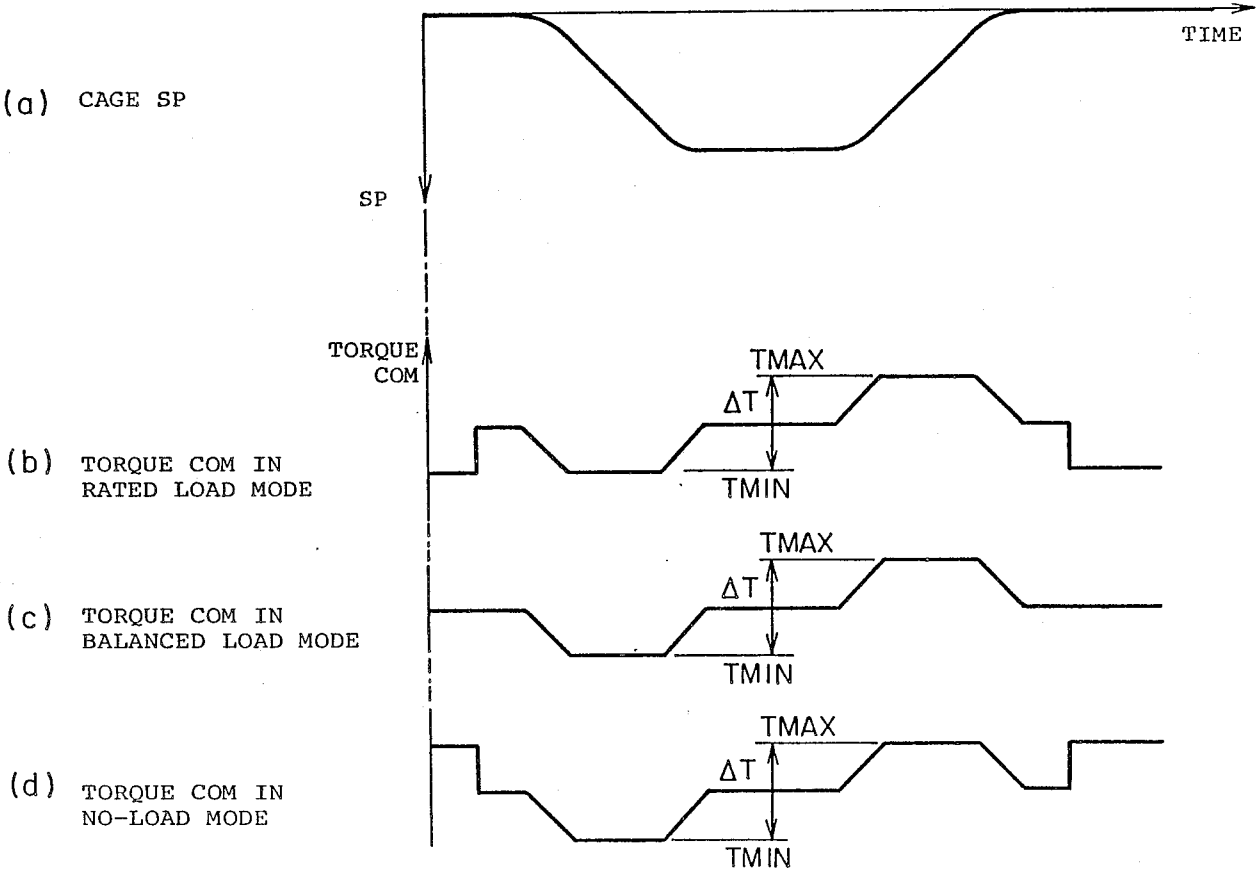
FIG. 4 is a characteristic diagram showing the relationships between a cage speed and a torque command in the descending operation of the elevator cage.

FIG. 4 shows the relationships between the cage speed and the torque command in the descending operation. (a) in FIG. 4 illustrates the cage speed, and (b), (c) and (d) illustrate the variations of the torque command 22*a* in the rated load mode, the balanced load mode and the no-load mode, respectively. During the descending operation, the torque command 22*a* becomes the maximum value TMAX in a deceleration condition and the minimum value TMIN in an acceleration condition. The torque difference $\Delta T$, however, is similar in magnitude to that of the ascending operation.

In the above, there have been described the cases where the brake gear operates normally. Now, there will be described cases where the elevator system is operated in the state in which the brake arms 1 are not opened due to, e. g., the disconnection of a brake coil circuit.

Figure 5:
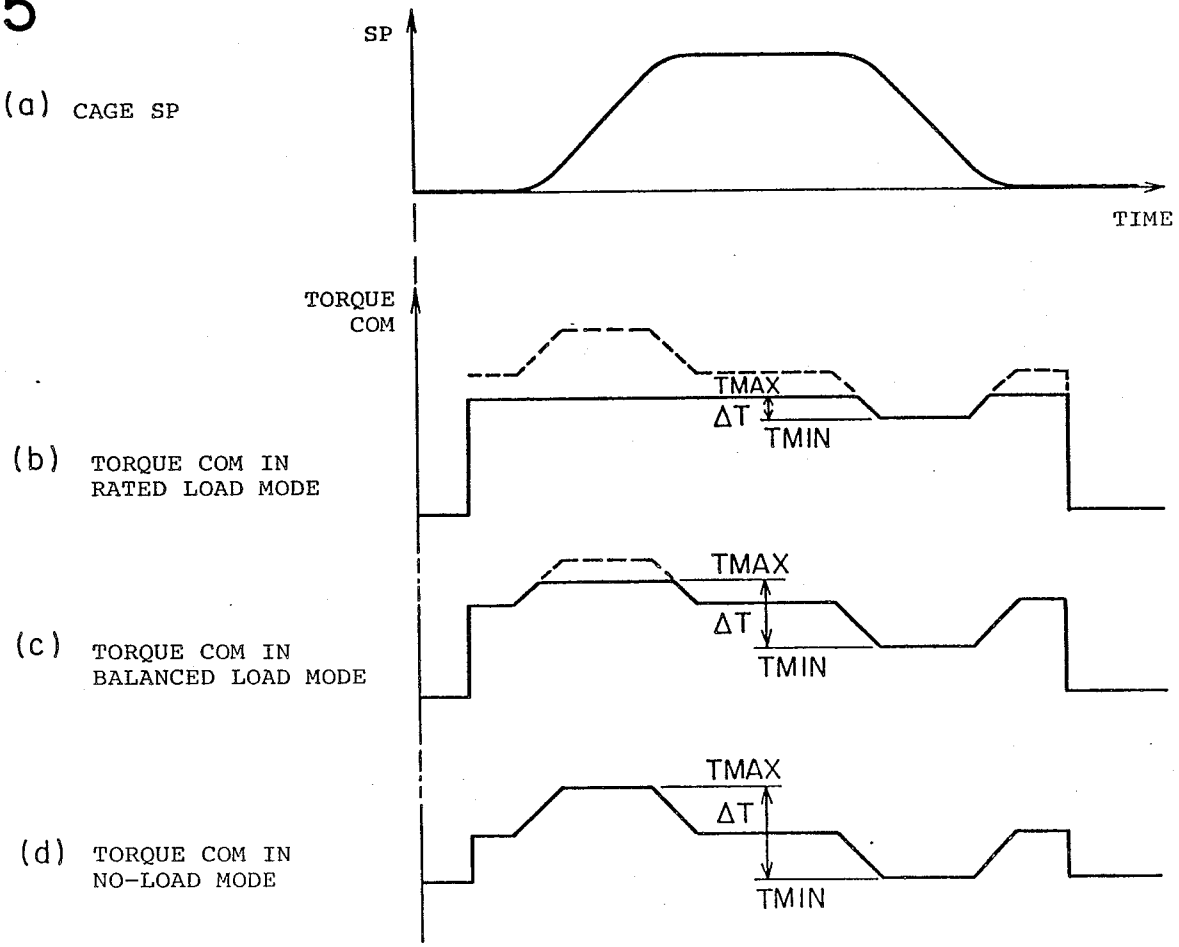
FIG. 5 is a characteristic diagram showing the relationships between a cage speed and a torque command in the ascending operation in the case where a motor is operated in a restrained state.

FIG. 5 shows a situation in the case where the ascending operation of the elevator cage proceeds with the brake gear actuated, and it corresponds to FIG. 3. In the operation of the elevator system, when the torque of the ascending operation of the cage under the rated load is let be 100%, the maximum torque of about 200–250% is usually required. Therefore, the torque control means 22 is provided with a limiter (for a limit value for the torque command 22*a*) which is not actuated in the normal operation, so as not to produce a torque greater than is necessary. In addition, the braking torque of the elevator cage is usually 200% or so. When driven while dragging the brake arms 1, the motor 35 undergoes a considerably high torque because it must generate a torque for overcoming the braking torque, besides the torque for running the cage 39.

As illustrated at (b) in FIG. 5, therefore, the torque command 22*a* in the full-load ascending operation of the cage exceeds the limit value and is limited over the whole region of the cage speed (at (a) in FIG. 5), and the torque difference $\Delta T = TMAX - TMIN$ becomes a very small value. In the balanced-load ascending operation, the torque difference ΔT becomes a value smaller than the normal value as illustrated at (c) in FIG. 5. In the no-load ascending operation, however, the torque difference ΔT is not appreciably different from the normal value as illustrated at (d) in FIG. 5.

Figure 6:
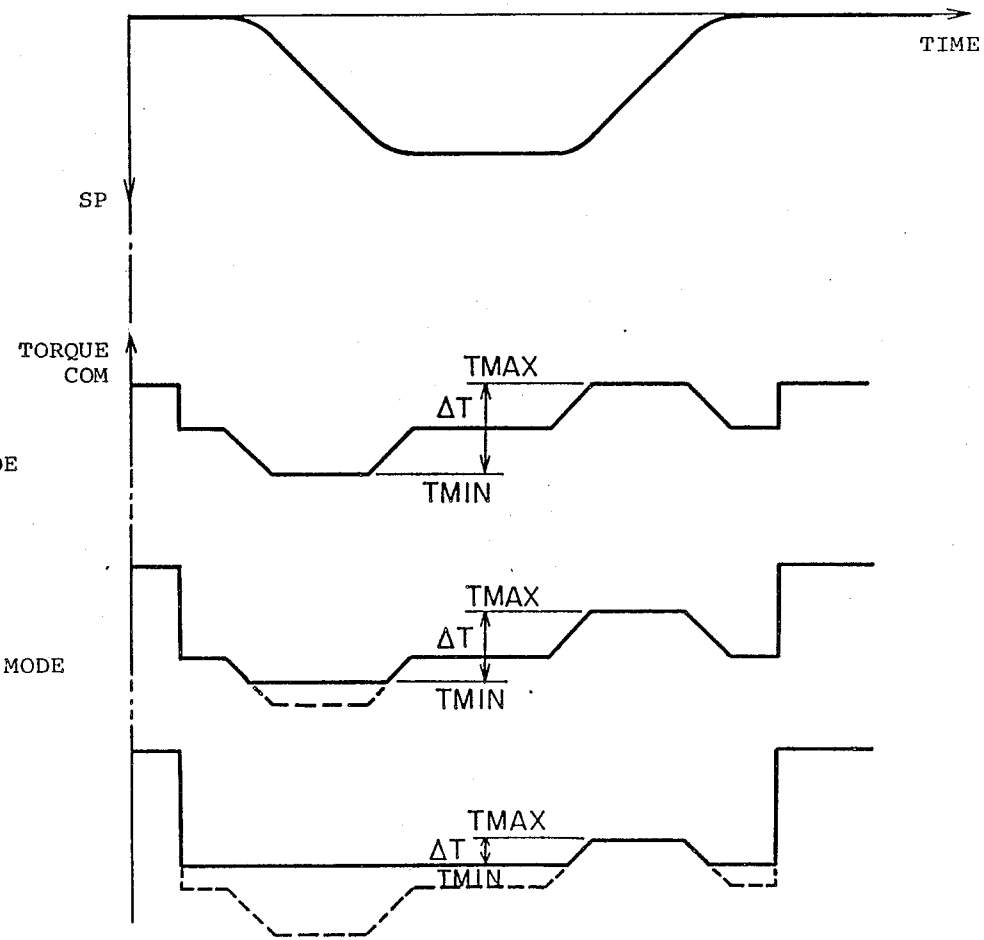
FIG. 6 is a characteristic diagram showing the relationships between a cage speed and a torque command in the descending operation in the case where the motor is operated in the restrained state.

FIG. 6 shows a situation in the case where the descending operation of the elevator cage proceeds with the brake gear held unreleased, and (a)–(d) in FIG. 6 correspond to those in FIG. 4, respectively. In the case of the descending operation, the torque difference ΔT becomes the smallest in the no-load mode, it becomes a value smaller than the normal value in the balanced load mode, and it becomes substantially the same value as the normal value in the rated load mode.

As thus far described, the inferior release of the brake gear can be detected by monitoring the torque difference ΔT during one travel. By the way, in the no-load ascending operation and the rated-load descending operation, the torque differences ΔT are not considerably different from those of the normal operations even when the motor is driven while dragging the brake arms. In actuality, however, the repetition of only such operations for a long time does not occur at all. Accordingly, the abnormal release of the brake gear can be found out when any other mode of operation has been carried out.

Figure 7:
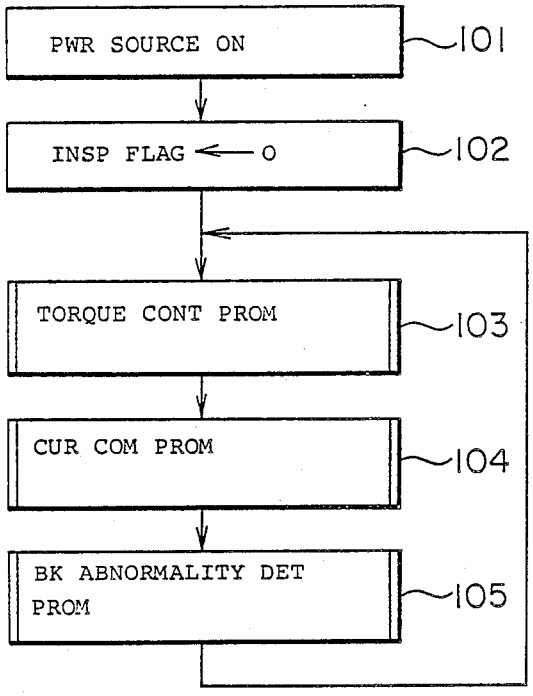
FIGS. 7 and 8 are flow charts of programs which a microcomputer executes.
Figure 8:
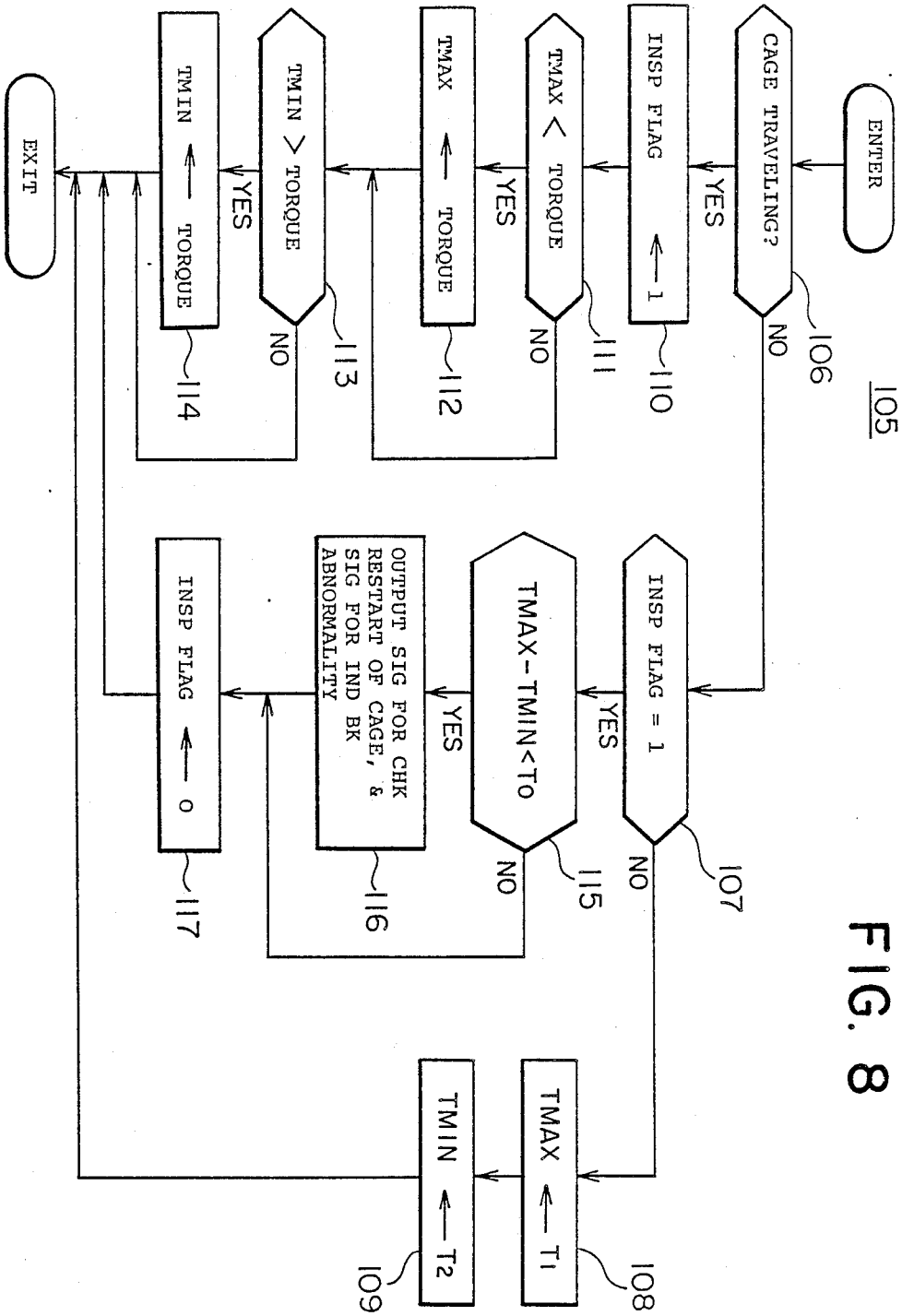

FIGS. 7 and 8 show flow charts of programs which the microcomputer 42 executes. A power source is turned ON at a step 101, and an inspection flag indicating whether or not the torque difference ΔT needs to be inspected is initialized to "0" at a step 102. Subsequently, a torque control program for use in the torque control means 22 is executed at a step 103. A current command program for use in the current command means 23 is executed at a step 104. A brake abnormality detection program for use in the brake abnormality detection means 29 is executed at a step 105, whereupon the control flow returns to the step 103 again. The microcomputer 42 executes the above programs in predetermined cycles repeatedly.

FIG. 8 shows the details of the brake abnormality detection program at the step 105. A step 106 decides if the cage is traveling, and the control flow proceeds to a step 107 when the cage is at a stop. Since the inspection flag has been set to "0" at the step 102, the control flow proceeds to a step 108, at which the maximum value TMAX of the torque command is set to $T_1$. The value $T_1$ is made the smallest value which can be calculated by the microcomputer 42. Subsequently, the minimum value TMIN of the torque command is set to $T_2$ at a step 109. The value $T_2$ is made the maximum value which can be calculated. During the stop of the cage, the above steps are repeatedly executed. Subsequently, when this program 105 is called out after the cage has started traveling, the step 106 decides that the cage is traveling, and it is followed by a step 110. The inspection flag is set to "1" at the step 110, and the maximum value TMAX the torque command is compared with the present torque command 22*a* at a step 111. When the value TMAX is smaller, it is renewed to the present torque command 22*a* at a step 112. When the value TMAX is equal to or greater than the present torque command 22*a*, the minimum value TMIN of the torque command is compared with the present torque command 22*a* at a step 113. When the value TMIN is greater, it is renewed to the present torque command 22*a* at a step 114. When the value TMIN is not greater, the operation leaves this program 105. While the cage is traveling, the above steps are repeated, whereby the maximum value and the minimum value of the torque command 22*a* are respectively set as the values TMAX and TMIN.

When this program 105 is called out after the cage has stopped, the step 106 decides that the cage is at a stop, and it is followed by the step 107. Since the inspection flag has been set to "1" at the step 110, the control flow subsequently proceeds to a step 115. At the step 115, the difference (TMAX−TMIN) is compared with a predetermined value $T_o$. In case of $TMAX-TMIN \geqq T_o$, it is judged that the brake gear is normal, and the inspection flag is returned to "0" at a step 117, whereupon the operation leaves this program 105. In case of $TMAX-TMIN < T_o$, the release of the brake gear is inferior as described before. At a step 116, therefore, an abnormality signal is delivered to the brake abnormality output circuit 30, simultaneously with the provision of a signal for checking the restart of the cage. Thus, the brake abnormality output circuit 30 issues an alarm or/and communicates the inoperable state to the exterior of the elevator control apparatus. In addition, a protective device which checks the restart of the motor by way of example is actuated.

Incidentally, although the foregoing embodiment detects the inferior release of the brake gear on the basis of the difference between the maximum value and minimum value of the torque command 22*a*, the inferior brake release can be similarly detected even with the current command or the current feedback signal which is approximately proportional to the torque command.

As described above, according to this invention, when the difference between the maximum value and minimum value of a motor torque command during one travel is smaller than a predetermined value, the inferior release of a brake gear is judged. Therefore, a switch and wiring for detecting the movement of the brake gear are dispensed with, and the mounted position of the switch need not be adjusted. These are remarkably effective in points of saving labor and conserving resources.

What is claimed is:

1. An elevator control apparatus comprising torque control means for calculating a torque command for a motor for hoisting an elevator cage, a brake which operates in response to a braking command so as to restrain said motor, brake abnormality detection means adapted to operate when a difference between a maximum value and a minimum value of the torque command is less than a predetermined value, and a brake abnormality output circuit which delivers a predetermined signal in response to the operation of said brake abnormality detection means.

2. An elevator control apparatus according to claim 1, wherein said brake abnormality output circuit delivers an alarm signal for indicating a brake abnormality, in response to the operation of said brake abnormality detection means.

3. An elevator control apparatus according to claim 1, wherein said brake abnormality output circuit delivers a notice signal for communicating a brake abnormality out of said apparatus, in response to the operation of said brake abnormality detection means.

* * * * *